US010806323B2

(12) United States Patent
Fischer

(10) Patent No.: US 10,806,323 B2
(45) Date of Patent: Oct. 20, 2020

(54) WAREWASH MACHINE AND RELATED HOOD CONSTRUCTION

(71) Applicant: ILLINOIS TOOL WORKS INC., Glenview, IL (US)

(72) Inventor: David L. Fischer, Fairborn, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 187 days.

(21) Appl. No.: 16/101,619

(22) Filed: Aug. 13, 2018

(65) Prior Publication Data

US 2019/0046002 A1 Feb. 14, 2019

Related U.S. Application Data

(60) Provisional application No. 62/545,008, filed on Aug. 14, 2017.

(51) Int. Cl.

| | |
|---|---|
| ***A47L 15/00*** | (2006.01) |
| ***A47L 15/42*** | (2006.01) |
| ***A47L 15/23*** | (2006.01) |

(52) U.S. Cl.

CPC ..... *A47L 15/4261* (2013.01); *A47L 15/0081* (2013.01); *A47L 15/23* (2013.01); *A47L 15/4259* (2013.01)

(58) Field of Classification Search

None

See application file for complete search history.

(56) References Cited

U.S. PATENT DOCUMENTS

| | | | |
|---|---|---|---|
| 2,063,746 | A | 12/1936 | Meeker |
| 2,073,521 | A | 3/1937 | Johnston |
| 2,128,008 | A | 8/1938 | Meeker |
| 2,158,904 | A | 5/1939 | Meeker |

(Continued)

FOREIGN PATENT DOCUMENTS

| | | | |
|---|---|---|---|
| DE | 3730316 | | 3/1989 |
| EP | 3228233 | A1 * | 3/2017 |

(Continued)

OTHER PUBLICATIONS

English machine translation of EP3228233A1.*

(Continued)

*Primary Examiner* — Michael E Barr
*Assistant Examiner* — Jason P Riggleman
(74) *Attorney, Agent, or Firm* — Thompson Hine LLP

(57) ABSTRACT

A warewash machine includes a wash zone having front, left and right access openings. At least one spray arm is disposed above or below the wash zone. A multi-sided hood assembly includes front, left, right and top side sections, the multi-sided hood assembly movable between a lowered closed position for washing and a raised open position for inlet and outlet of wares. The multi-sided hood assembly includes a lower hood unit with front, left and right sides and an upper hood unit with front, left, right and top sides, and a linkage assembly between the lower hood unit and the upper hood unit that causes the upper hood unit and the lower hood unit to move up or down together with the lower hood unit moving faster than the upper hood unit to cause telescoping of the upper hood unit and the lower hood unit as the hood assembly moves.

12 Claims, 4 Drawing Sheets

(56) References Cited

U.S. PATENT DOCUMENTS

| | | | |
|---|---|---|---|
| 2,217,705 | A | 10/1940 | Rataiczak |
| 2,229,663 | A | 1/1941 | Meeker |
| 2,707,961 | A | 10/1955 | Geiger |
| 2,850,025 | A | 9/1958 | Bond |
| 2,947,311 | A | 8/1960 | Fox |
| 3,049,391 | A | 8/1962 | Meeker |
| 3,125,105 | A | 5/1964 | Geiger |
| D199,196 | S | 9/1964 | Meeker |
| D205,466 | S | 8/1966 | Meeker |
| 3,328,062 | A | 6/1967 | Geiger |
| 3,706,317 | A | 12/1972 | Fox |
| 3,844,299 | A | 12/1974 | Athey |
| 3,911,943 | A | 10/1975 | Athey |
| 3,949,772 | A | 4/1976 | Hartmann |
| 3,949,782 | A | 4/1976 | Athey |
| 4,018,239 | A | 4/1977 | Caldwell |
| 4,086,929 | A | 5/1978 | Focht |
| 4,086,938 | A | 5/1978 | Churley |
| 4,134,413 | A | 1/1979 | Noren |
| 4,187,122 | A | 2/1980 | Query |
| 5,257,638 | A | 11/1993 | Alvemarker |
| 5,630,438 | A | 5/1997 | Hoover |
| 6,006,767 | A | 12/1999 | Hecker |
| 6,338,352 | B1 | 1/2002 | Raches |
| 7,021,322 | B2 | 4/2006 | Kramer |
| 8,500,917 | B2 | 8/2013 | Kramer |
| 9,131,825 | B2 | 9/2015 | Tameishi |
| 9,618,211 | B2 | 4/2017 | Stone |
| 9,962,059 | B2 | 5/2018 | Kramer |

FOREIGN PATENT DOCUMENTS

| | | |
|---|---|---|
| GB | 1121585 | 7/1968 |
| JP | H02109554 | 9/1990 |
| JP | H02109554 U | 9/1990 |

OTHER PUBLICATIONS

PCT, International Searching Authority Invitation to Pay Fees, Partial PCT Search Report, International Application No. PCT/US2018/046413; dated Jan. 10, 2019, 20 pages.

PCT, International Searching Authority Invitation to Pay Fees, Partial PCT Search Report, International Application No. PCT/US2018/046413; dated Nov. 6, 2018; 11 pages.

Jackson Tempstar HH-E Manual, last updated Oct. 16, 2018, 76 pages, (please see pages 11/76, 12/76, 37/76 and 38/76).

* cited by examiner

WAREWASH MACHINE AND RELATED HOOD CONSTRUCTION

TECHNICAL FIELD

This application relates generally to warewash machines and, more specifically, to a hood construction for hood-type warewash machines.

BACKGROUND

Warewash machines have become fairly standardized in the industry. Typically, a standard warewasher has a washing chamber with an access opening that allows wares to be placed within the chamber for a washing operation. While larger washing chambers have become desirable, especially taller chambers, it is necessary that the warewash machines having larger washing chambers be dimensioned to fit within a volume that can be accommodated by, e.g., a dish room of a restaurant, especially those dish rooms with limited ceiling heights. FIGS. 9 and 10 show an exemplary prior art machine 5 with a hood assembly 7 that raises and lowers without collapsing or telescoping.

As the cost associated with space is constantly rising, kitchens are getting smaller and smaller and this has made compactness or size of equipment very prominent i.e. foot print as well as height. To this end, a collapsible, vertically opening, telescoping door has been proposed in the past per U.S. Pat. No. 5,630,438. The telescoping door includes multiple panels that can slide relative to each other as the door is moved to the open position, with the lower panel moving first until a lip on the lower panel moves up into engagement with the upper panel, at which point both panels then move upward. This design has limitations in that the full weight of the upper panel is taken by the lift force applied to the lower panel.

Accordingly, it would be desirable to provide a more user friendly telescoping warewasher door system, and on that is particularly suited for use with multi-sided doors, which are also referred to as hoods.

SUMMARY

In one aspect, a warewash machine includes a housing in part defining a wash zone having front, left and right access openings. At least one spray arm is disposed above or below the wash zone, the spray arm configured to spray liquid toward the wash zone. A multi-sided hood assembly includes front, left, right and top side sections, the multi-sided hood assembly movable between a lowered closed position for washing and a raised open position for inlet and outlet of wares. When the multi-sided hood assembly is in the lowered closed position, the multi-sided hood assembly closes the front, left and right access openings. When the multi-sided hood assembly is in the raised open position, the front, left and right access openings are open to permit access to the wash zone for inlet and outlet of wares. The multi-sided hood assembly includes a lower hood unit with front, left and right sides and an upper hood unit with front, left, right and top sides, and a linkage assembly between the lower hood unit and the upper hood unit that causes the upper hood unit and the lower hood unit to move up or down together with the lower hood unit moving faster than the upper hood unit to cause telescoping of the upper hood unit and the lower hood unit as the hood assembly moves.

In one implementation, the linkage assembly includes a pivot arm arranged to pivot about a fixed axis at a rear of the housing, a first pivot link connecting the pivot arm to the lower hood unit and a second pivot link connecting the pivot arm to the upper hood unit.

In one implementation, the pivot arm includes a spring-bias assembly that provides lift assistance when the multi-sided hood assembly moves from the lowered closed position to the raised open position.

In one implementation, an amount of lift assistance applied to the lower hood unit is greater than an amount of lift assistance applied to the upper hood unit.

In one implementation, the lower hood unit includes a fixed lift arm by which the multi-sided hood assembly is raised and lowered.

In one implementation, the upper hood unit also includes a rear side that moves with the upper hood unit.

In another aspect, a warewash machine includes a housing in part defining a wash zone having front, left and right access openings. At least one spray arm is disposed above or below the wash zone, the spray arm configured to spray liquid toward the wash zone. A multi-sided hood assembly includes front, left, right and top sections, the multi-sided hood assembly movable between a lowered closed position for washing and a raised open position. When the multi-sided hood assembly is in the lowered closed position, the front, left and right access openings are covered. When the multi-sided hood assembly is in the raised open position, the front, left and right access openings are open to permit access to the wash zone. The multi-sided hood assembly includes a lower hood unit with front, left and right sides and an upper hood unit with front, left, right, top and back sides. The lower hood unit collapsingly telescopes with the upper hood unit during movement of multi-sided hood assembly from the lowered closed position to the raised open position. The rear side of the upper hood unit moves upward and downward with the upper hood unit to maintain an enclosed capture volume to retain moist hot air when the multi-sided hood assembly is moved from the lowered closed position to the raised open position.

In one implementation of the foregoing aspect, a linkage assembly between the lower hood unit and the upper hood unit that is configured to cause the lower hood unit to move faster than the upper hood unit.

In one implementation, the linkage assembly includes at least one pivot arm that pivots about a substantially horizontal pivot axis, a first pivot link connecting the pivot arm to the lower hood unit and a second pivot link connecting the pivot arm to the upper hood unit.

In one implementation, the first pivot link is at a first distance from the pivot axis and the second pivot link is at a second distance from the pivot axis, and the first distance is greater than the second distance.

In a further aspect, a warewash machine includes a housing in part defining a wash zone having front, left and right access openings. At least one spray arm is disposed above or below the wash zone, the spray arm configured to spray liquid toward the wash zone. A multi-sided hood assembly includes front, left, right and top sections, the multi-sided hood assembly movable between a lowered closed position for washing and a raised open position. When the multi-sided hood assembly is in the lowered closed position, the front, left and right access openings are covered. When the multi-sided hood assembly is in the raised open position, the front, left and right access openings are open to permit access to the wash zone. The multi-sided hood assembly includes a lower hood unit and an upper hood unit, and a linkage assembly between the lower hood unit and the upper hood unit. The linkage assembly includes at least one pivot arm that pivots about a substantially horizontal pivot axis, a first pivot link connecting the pivot arm to the lower hood unit and a second pivot link connecting the pivot arm to the upper hood unit.

In one implementation of the foregoing aspect, the first pivot link is at a first distance from the pivot axis and the second pivot link is at a second distance from the pivot axis, and the first distance is greater than the second distance.

The details of one or more embodiments are set forth in the accompanying drawings and the description below. Other features, objects, and advantages will be apparent from the description and drawings, and from the claims.

DETAILED DESCRIPTION

Figure 1:
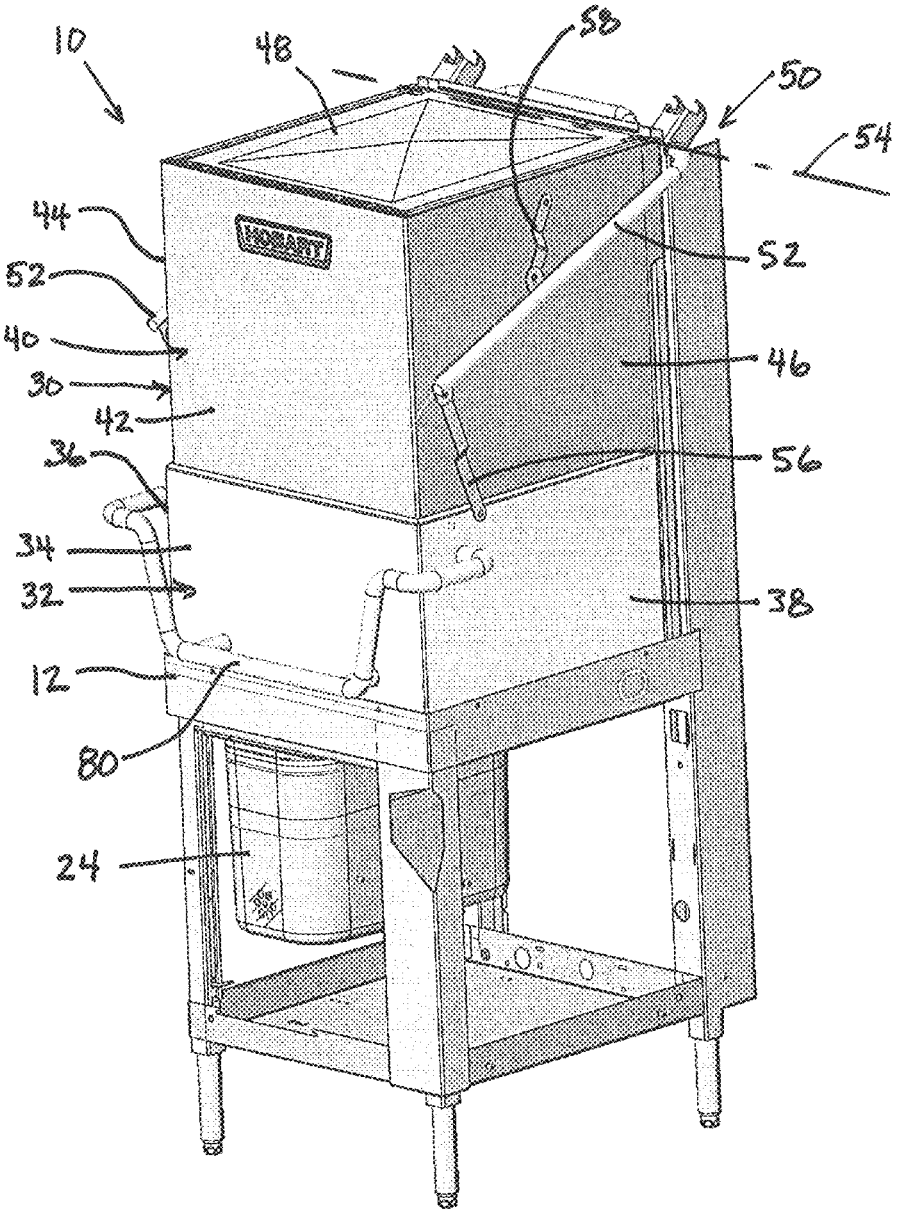
FIG. 1 is a perspective view of a warewash machine.

Referring to FIGS. 1-8, a warewash machine 10 includes a housing 12 in part defining a wash zone 14 having front 16, left 18 and right 20 access openings. Here, the openings intersect to provide obstruction free wash zone access when the hood assembly is opened. At least one spray arm 22 is disposed above or below the wash zone, the spray arm configured to spray liquid toward the wash zone. The spray arm(s) may be rotating spray arm(s) as is common in the industry, but fixed spray arms are also possible. A sump 24 is provided below the wash zone to collect falling liquid, which can then be recirculated to the spray arms via a pump during a wash step of a cleaning cycle. At least one spray arm may also be connected to a source of final-rinse liquid (e.g., a booster tank heating fresh hot water with or without rinse solution) for a rinsing step that follows the washing step.

A multi-sided hood assembly 30 includes front, left, right and top side sections. The multi-sided hood assembly is movable along the housing 12 between a lowered closed position (FIGS. 1, 3 and 7) for washing and a raised open position (FIGS. 6 and 8) for inlet and outlet of wares. When the multi-sided hood assembly is in the closed position the various panels of the hood assembly close or cover the front, left and right access openings. When the multi-sided hood assembly is in the open position the front, left and right access openings are open to permit access to the wash zone for inlet and egress of wares. The multi-sided hood assembly 30 includes a lower hood unit 32 with front 34, left 36 and right 38 sides (e.g., in the form of panels) and an upper hood unit 40 with front 42, left 44, right 46 and top 48 sides (e.g., in the form of panels). Lower hood unit 32 is open at its top to receive the upper hood unit 40, and both hood units are open at their respective bottoms.

A linkage assembly 50 is provided between the lower hood unit and the upper hood unit. Here, the linkage assembly includes pivot arms 52 along the left and right sides of the units and arranged to pivot about a fixed axis 54 at a rear of the housing 12. A pivot link 56 connects the right pivot arm 52 to the lower hood unit and a pivot link 58 connects the right pivot arm 52 to the upper hood unit. Similar links are provided for the left pivot arm. The pivot link 56 includes one end pivotably connected to the side of the lower hood unit 32, and the other end pivotably connected to the arm 52 or a bracket mounted on the arm. Similarly, the pivot link 58 includes one end pivotably connected to the side of the upper hood unit 40, and the other end pivotably connected to the arm 52 or a bracket mounted on the arm.

As best seen in the progression of FIGS. 3-6, the linkage assembly causes the upper hood unit 40 and the lower hood unit 32 to move up or down together, with the lower hood unit 32 moving faster than the upper hood unit 40 due to the distance between pivot link 58 and axis 54 being greater than the distance between pivot link 58 and pivot axis 54. This difference in speed of movement causes a progressive telescoping of the upper hood unit 40 and the lower hood unit 30 (more specifically the lower hood unit sliding along the outside upper hood unit as both hood units move) as the hood assembly moves up and down. As used herein the term telescoping refers to the relative sliding movement of the lower hood unit 32 along the upper hood unit 40, either in a collapsing manner (i.e., the bottom edge of the lower hood unit moving closer to the bottom edge of the upper hood unit as the hood assembly is raised) or in an expanding manner (i.e., the bottom edge of the lower hood unit moving further away from the bottom edge of the upper hood unit as the hood assembly is lowered). A lift arm 80 is fixed to the front of the lower hood unit 32 and may be used by operators to raise and lower the hood assembly.

Figure 2:
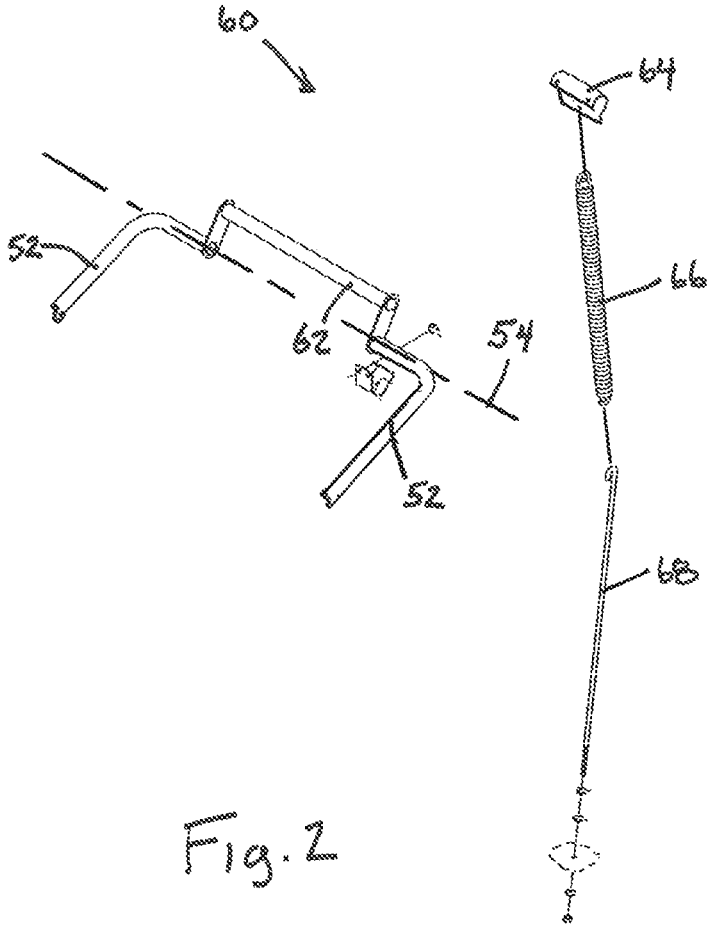
FIG. 2 is a partial perspective of the warewash machine pivot arm and spring bias assembly.
Figure 3:
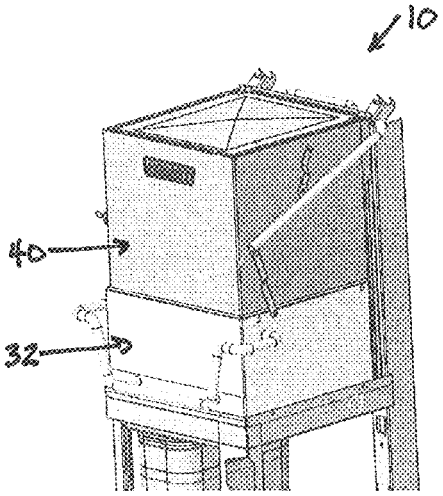
FIGS. 3-6 are partial perspectives showing progressive movement of the multi-sided hood assembly of the warewasher from a closed position to an open position.
Figure 4:
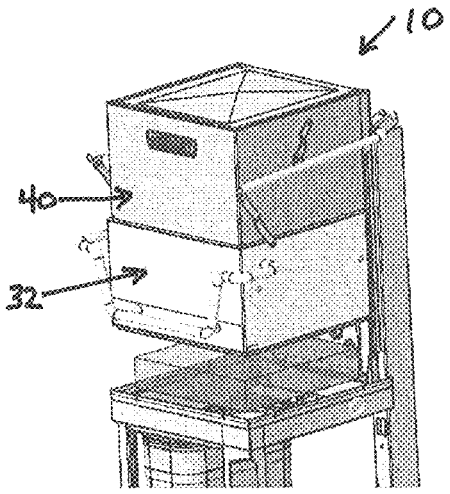
Figure 5:
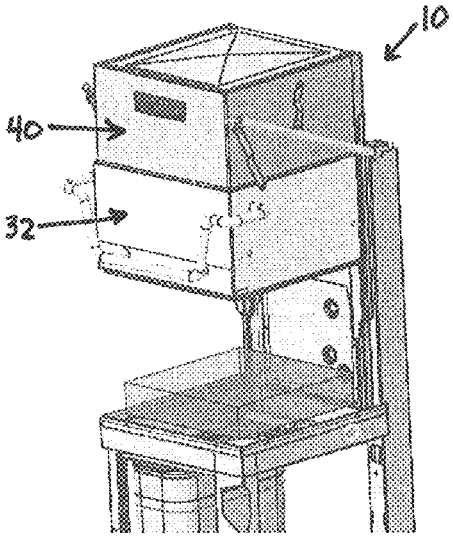
Figure 6:
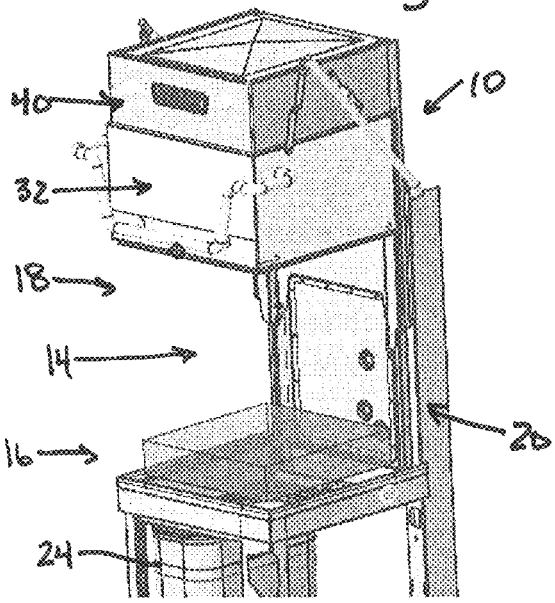

As seen in FIG. 2, the pivot arms 52 include a spring-bias assembly 60 that provides lift assistance when moving from multi-sided hood assembly from the closed position to the open position. Here, the pivot arms 52 are interconnected with each other by a rear arm 62, and the spring-bias assembly includes a hanger bracket 64 to engage rear arm 62, a spring 66 that connects at one end to the hanger bracket 64, a rod hook 68 that connects to the other end of the spring 66, with the lower end of the rod hook connecting to the rear side of the housing. The spring provides a downward pulling force on arm 62 at the opposite side of the pivot axis 54, which tends to bias the arms 62 to pivot upward about the axis 54, thus urging the hood units upward as well. An amount of lift assistance applied to the lower hood unit 32 is greater than an amount of lift assistance applied to the upper hood unit 40, again due to the relative positions and orientations of the respective pivot links 56 and 58.

Figure 8:
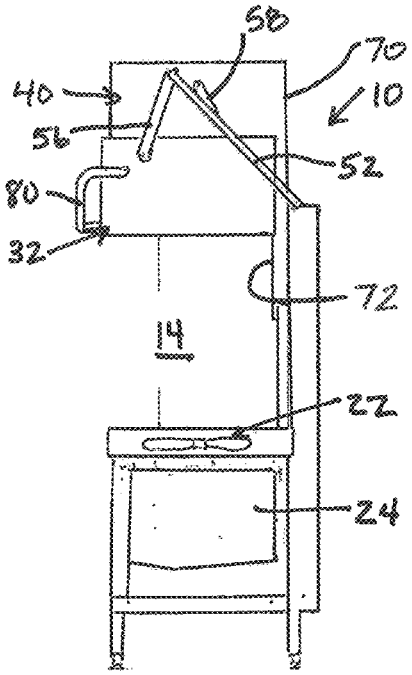

As seen in FIG. 8, the upper hood unit 40 also includes a rear side 70 that moves up and down with the upper hood unit to maintain an enclosed capture volume that retains moist hot air when the multi-sided hood assembly is moved from the closed position to the open position. A rear side 72 of the housing 12 is also closed and may include a tracks or tacks to assist in movement of the hood units.

Figure 9:
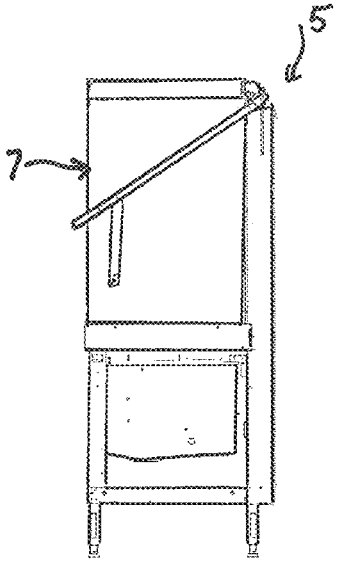
Fig. 9 (Prior Art)
FIGS. 9 and 10 show side elevations of a prior art warewasher with the hood in closed and open positions respectively.
Figure 7:
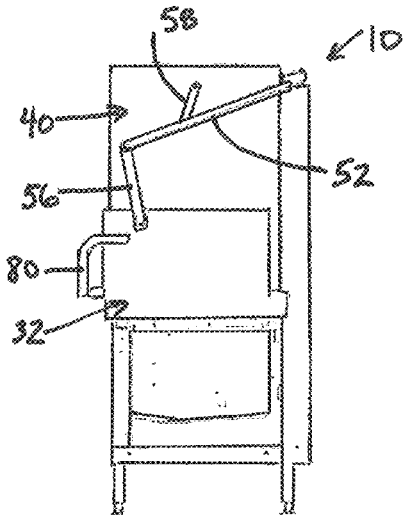
FIGS. 7 and 8 show side elevations of the warewasher with the multi-sided hood assembly in closed and open positions respectively.
Figure 10:
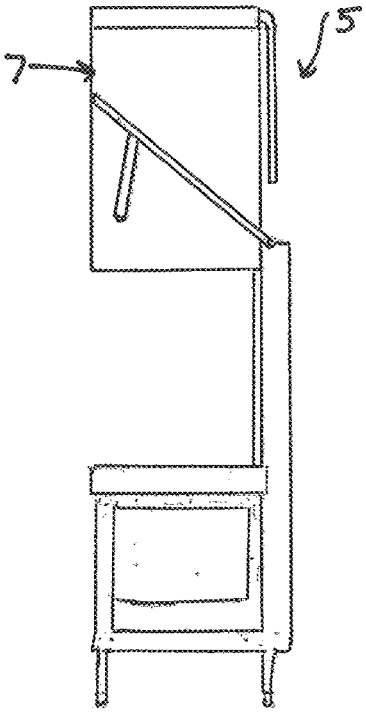
Fig. 10 (Prior Art)

As seen by comparison of FIGS. 7 and 8 with the views of FIGS. 9 and 10 for a prior art machine 5 with non-telescoping hood 7, the overall height of the warewash machine when the hood is up is reduced by the telescoping assembly, effectively accommodating demands of lower ceiling heights.

It is to be clearly understood that the above description is intended by way of illustration and example only, is not intended to be taken by way of limitation, and that other changes and modifications are possible.

What is claimed is:

1. A warewash machine comprising:

a housing in part defining a wash zone having front, left and right access openings;

at least one spray arm disposed above or below the wash zone, the spray arm configured to spray liquid toward the wash zone; and a multi-sided hood assembly including front, left, right and top side sections, the multi-sided hood assembly movable between a lowered closed position for washing and a raised open position for inlet and outlet of wares, wherein, when the multi-sided hood assembly is in the lowered closed position, the multi-sided hood assembly closes the front, left and right access openings, wherein, when the multi-sided hood assembly is in the raised open position, the front, left and right access openings are open to permit access to the wash zone for inlet and outlet of wares, wherein the multi-sided hood assembly includes a lower hood unit with front, left and right sides and an upper hood unit with front, left, right and top sides, and a linkage assembly between the lower hood unit and the upper hood unit that causes the upper hood unit and the lower hood unit to move up or down together with the lower hood unit moving faster than the upper hood unit to cause telescoping of the upper hood unit and the lower hood unit as the hood assembly moves.

2. The warewash machine of claim 1 wherein the linkage assembly includes a pivot arm arranged to pivot about a fixed axis at a rear of the housing, a first pivot link connecting the pivot arm to the lower hood unit and a second pivot link connecting the pivot arm to the upper hood unit.

3. The warewash machine of claim 2 wherein the pivot arm includes a spring-bias assembly that provides lift assistance when the multi-sided hood assembly moves from the lowered closed position to the raised open position.

4. The warewash machine of claim 3 wherein an amount of lift assistance applied to the lower hood unit is greater than an amount of lift assistance applied to the upper hood unit.

5. The warewash machine of claim 2 wherein the lower hood unit includes a fixed lift arm by which the multi-sided hood assembly is raised and lowered.

6. The warewash machine of claim 1 wherein the upper hood unit also includes a rear side that moves with the upper hood unit.

7. A warewash machine comprising:

a housing in part defining a wash zone having front, left and right access openings;

at least one spray arm disposed above or below the wash zone, the spray arm configured to spray liquid toward the wash zone; and a multi-sided hood assembly including front, left, right and top sections, the multi-sided hood assembly movable between a lowered closed position for washing and a raised open position, wherein, when the multi-sided hood assembly is in the lowered closed position, the front, left and right access openings are covered, wherein, when the multi-sided hood assembly is in the raised open position, the front, left and right access openings are open to permit access to the wash zone, wherein the multi-sided hood assembly includes a lower hood unit with front, left and right sides and an upper hood unit with front, left, right, top and back sides, wherein the lower hood unit collapsingly telescopes with the upper hood unit during movement of multi-sided hood assembly from the lowered closed position to the raised open position, and the rear side of the upper hood unit moves upward and downward with the upper hood unit to maintain an enclosed capture volume to retain moist hot air when the multi-sided hood assembly is moved from the lowered closed position to the raised open position.

8. The warewash machine of claim 7, further comprising:

a linkage assembly between the lower hood unit and the upper hood unit that is configured to cause the lower hood unit to move faster than the upper hood unit.

9. The warewash machine of claim 8 wherein the linkage assembly includes at least one pivot arm that pivots about a substantially horizontal pivot axis, a first pivot link connecting the pivot arm to the lower hood unit and a second pivot link connecting the pivot arm to the upper hood unit.

10. The warewash machine of claim 9 wherein the first pivot link is at a first distance from the pivot axis and the second pivot link is at a second distance from the pivot axis, and the first distance is greater than the second distance.

11. A warewash machine comprising:

a housing in part defining a wash zone having front, left and right access openings;

at least one spray arm disposed above or below the wash zone, the spray arm configured to spray liquid toward the wash zone; and a multi-sided hood assembly including front, left, right and top sections, the multi-sided hood assembly movable between a lowered closed position for washing and a raised open position, wherein, when the multi-sided hood assembly is in the lowered closed position, the front, left and right access openings are covered, wherein, when the multi-sided hood assembly is in the raised open position, the front, left and right access openings are open to permit access to the wash zone, wherein the multi-sided hood assembly includes a lower hood unit and an upper hood unit, and a linkage assembly between the lower hood unit and the upper hood unit, wherein the linkage assembly includes at least one pivot arm that pivots about a substantially horizontal pivot axis, a first pivot link connecting the pivot arm to the lower hood unit and a second pivot link connecting the pivot arm to the upper hood unit.

12. The warewash machine of claim 11 wherein the first pivot link is at a first distance from the pivot axis and the second pivot link is at a second distance from the pivot axis, and the first distance is greater than the second distance.

* * * * *